US011282668B2

(12) United States Patent
Kenmotsu et al.

(10) Patent No.: US 11,282,668 B2
(45) Date of Patent: Mar. 22, 2022

(54) X-RAY TUBE AND A CONTROLLER THEREOF

(71) Applicant: Nanox Imaging PLC, Gibraltar (GI)

(72) Inventors: Hidenori Kenmotsu, Tokyo (JP); Hitoshi Masuya, Chiba (JP)

(73) Assignee: NANO-X IMAGING LTD., Neve-Ilan (IL)

( * ) Notice: Subject to any disclaimer, the term of this patent is extended or adjusted under 35 U.S.C. 154(b) by 33 days.

(21) Appl. No.: 15/472,549

(22) Filed: Mar. 29, 2017

(65) Prior Publication Data

US 2018/0075997 A1 Mar. 15, 2018

Related U.S. Application Data

(60) Provisional application No. 62/316,365, filed on Mar. 31, 2016.

(51) Int. Cl.
*H01J 35/06* (2006.01)
*H01J 35/08* (2006.01)
(Continued)

(52) U.S. Cl.
CPC ..... *H01J 35/305* (2013.01); *H01J 35/06* (2013.01); *H01J 35/064* (2019.05); *H01J 35/08* (2013.01); *H01J 35/10* (2013.01); *H01J 35/101* (2013.01); *H01J 35/112* (2019.05); *H01J 35/14* (2013.01); *H01J 35/153* (2019.05); *H01J 35/16* (2013.01); *H01J 35/24* (2013.01); *H01J 35/26* (2013.01); *H01J 35/30* (2013.01); *H01J 2235/06* (2013.01); *H01J 2235/064* (2013.01); *H01J 2235/066* (2013.01); *H01J 2235/068* (2013.01); *H01J 2235/08* (2013.01); *H01J 2235/086* (2013.01); *H01J 2235/10* (2013.01); *H01J 2235/16* (2013.01); *H01J 2235/161* (2013.01); *H01J 2235/162* (2013.01)

(58) Field of Classification Search
CPC .. H01J 35/06; H01J 35/08; H01J 35/10; H01J 35/101; H01J 35/14; H01J 35/16; H01J 35/24; H01J 35/26; H01J 35/30; H01J 35/305; H01J 2235/06; H01J 2235/064; H01J 2235/066; H01J 2235/068; H01J 2235/08; H01J 2235/086; H01J 2235/10; H01J 2235/16; H01J 2235/161; H01J 35/02; H01J 35/025; H01J 35/064; H01J 35/065; H01J 35/1017; H01J 2235/162
USPC ..... 378/121, 124, 125, 134, 137, 10, 98.6, 378/113, 136
See application file for complete search history.

(56) References Cited

U.S. PATENT DOCUMENTS 3,610,984 A * 10/1971 Seki ..... H01J 35/10 378/125
4,712,226 A * 12/1987 Horbaschek ..... H01J 35/06 378/124
(Continued)

*Primary Examiner* — Allen C. Ho
(74) *Attorney, Agent, or Firm* — Alphapatent Associates, Ltd; Daniel J. Swirsky

(57) ABSTRACT

An X-ray tube including a vacuum vessel, a cathode and an anode fixedly disposed inside the vacuum vessel, and a rotary mechanism that rotates the vacuum vessel, where the cathode is disposed on the circumference with a rotary shaft of the rotary mechanism as its center and includes multiple cathode parts that can individually be turned ON/OFF, and where the anode includes parts opposite to the multiple cathode parts, respectively.

8 Claims, 4 Drawing Sheets

(51) Int. Cl.

| | |
|---|---|
| ***H01J 35/10*** | (2006.01) |
| ***H01J 35/14*** | (2006.01) |
| ***H01J 35/16*** | (2006.01) |
| ***H01J 35/24*** | (2006.01) |
| ***H01J 35/26*** | (2006.01) |
| ***H01J 35/30*** | (2006.01) |

(56) References Cited

U.S. PATENT DOCUMENTS 4,748,650 A * 5/1988 Ammann ..... H01J 35/30 378/137
4,823,371 A * 4/1989 Grady ..... H01J 35/066 378/134
4,993,055 A * 2/1991 Rand ..... H01J 35/107 378/125
5,150,398 A 9/1992 Nishioka et al.
5,511,105 A * 4/1996 Knott ..... H01J 35/24 378/125
5,703,926 A * 12/1997 Bischof ..... H01J 35/10 378/125
5,812,632 A * 9/1998 Schardt ..... H01J 35/14 378/137
5,822,395 A * 10/1998 Schardt ..... H01J 35/14 378/137
5,857,008 A * 1/1999 Reinhold ..... G21K 7/00 378/126
5,883,936 A * 3/1999 Hell ..... H01J 35/26 378/119
5,898,755 A * 4/1999 Meusel ..... H01J 35/30 378/137
5,909,479 A * 6/1999 Rother ..... H01J 35/16 378/119
6,009,146 A * 12/1999 Adler ..... G01N 23/06 378/98.6
6,055,294 A * 4/2000 Foerst ..... H01J 35/30 378/137
6,084,942 A * 7/2000 Hell ..... H01J 35/105 378/130
6,091,799 A * 7/2000 Schmidt ..... H01J 35/30 378/113
6,111,934 A * 8/2000 Foerst ..... H01J 35/30 378/121
6,125,167 A * 9/2000 Morgan ..... H01J 35/10 378/121
6,128,367 A * 10/2000 Foerst ..... H01J 35/30 378/121
6,164,820 A * 12/2000 Hell ..... A61B 6/032 378/119
6,178,226 B1 * 1/2001 Hell ..... H05G 1/34 378/109
6,181,771 B1 * 1/2001 Hell ..... H01J 35/305 378/119
6,212,257 B1 * 4/2001 Mattern ..... H01J 35/24 378/125
6,213,639 B1 * 4/2001 Hell ..... H01J 35/107 378/200
6,252,935 B1 * 6/2001 Styrnol ..... H01J 35/10 378/137
6,272,205 B1 * 8/2001 Hell ..... H01J 35/305 378/125
6,292,538 B1 9/2001 Hell et al.
6,333,968 B1 * 12/2001 Whitlock ..... B82Y 10/00 378/122
6,333,969 B1 * 12/2001 Kujirai ..... H01J 35/066 378/138
6,339,635 B1 * 1/2002 Schardt ..... H01J 35/305 378/113
6,364,527 B1 * 4/2002 Kutschera ..... H05G 1/04 378/127
6,396,901 B1 * 5/2002 Hell ..... H05G 1/04 378/130
6,412,979 B1 * 7/2002 Hell ..... A61B 6/035 378/130
6,426,998 B1 * 7/2002 Hell ..... H01J 35/305 378/127
6,480,572 B2 * 11/2002 Harris ..... H01J 35/066 378/136
6,553,096 B1 * 4/2003 Zhou ..... A61B 6/4028 378/122
6,674,837 B1 * 1/2004 Taskar ..... A61B 6/00 378/122
6,760,407 B2 * 7/2004 Price ..... H01J 35/065 378/119
6,807,248 B2 * 10/2004 Mihara ..... H01J 35/04 378/10
6,876,724 B2 * 4/2005 Zhou ..... A61B 6/032 378/119
6,947,522 B2 * 9/2005 Wilson ..... H01J 35/10 378/124
6,961,407 B2 * 11/2005 Deuringer ..... G01L 21/30 378/109
6,975,703 B2 * 12/2005 Wilson ..... H01J 35/30 378/124
6,975,704 B2 * 12/2005 Neumeier ..... H01J 35/10 378/125
6,977,991 B1 * 12/2005 Neumeier ..... H01J 35/10 378/137
6,980,627 B2 * 12/2005 Qiu ..... B82Y 10/00 378/122
6,993,116 B1 * 1/2006 Heidrich ..... H01J 35/16 378/121
7,025,502 B2 * 4/2006 Freudenberger ..... H01J 35/101 378/130
7,065,179 B2 * 6/2006 Block ..... H01J 35/10 378/124
7,082,182 B2 * 7/2006 Zhou ..... A61B 6/032 378/10
7,082,188 B2 * 7/2006 Deuringer ..... H05G 1/52 378/113
7,085,351 B2 * 8/2006 Lu ..... A61B 6/4488 315/169.3
7,085,354 B2 * 8/2006 Kanagami ..... H01J 35/066 378/136
7,103,146 B2 * 9/2006 Lenz ..... H01J 35/18 378/121
7,120,222 B2 * 10/2006 Hoffman ..... A61B 6/4007 378/5
7,192,031 B2 * 3/2007 Dunham ..... A61B 6/032 378/122
7,266,179 B2 * 9/2007 Deuringer ..... H01J 35/14 378/137
7,280,639 B2 * 10/2007 Hömig ..... H01J 35/305 378/130
7,295,651 B2 * 11/2007 Delgado ..... G01N 23/046 378/10
7,382,865 B2 * 6/2008 Deutscher ..... G21F 3/00 378/137
7,406,156 B2 * 7/2008 Lenz ..... H01J 35/105 378/127
7,428,297 B2 * 9/2008 Eilbert ..... H01J 35/14 378/134
7,443,957 B2 * 10/2008 Freudenberger ..... H01J 35/106 378/130
7,483,518 B2 * 1/2009 Hamill ..... G21K 1/10 378/119
7,529,344 B2 * 5/2009 Oreper ..... H01J 35/065 378/134
7,609,815 B2 * 10/2009 Leung ..... B82Y 10/00 378/136
7,639,774 B2 * 12/2009 De Man ..... A61B 6/032 378/124
7,809,114 B2 * 10/2010 Zou ..... H01J 1/3048 378/122
7,826,594 B2 * 11/2010 Zou ..... H01J 1/30 378/10
7,869,571 B2 * 1/2011 Hsieh ..... A61B 6/032 378/124

(56) References Cited

U.S. PATENT DOCUMENTS 7,873,146 B2 * 1/2011 Okunuki ..... H01J 35/065 378/122
7,881,425 B2 * 2/2011 Vermilyea ..... H01J 35/10 378/19
7,949,102 B2 * 5/2011 Behling ..... A61B 6/032 378/119
7,978,816 B2 * 7/2011 Matsuura ..... A61B 6/032 378/62
7,991,114 B2 * 8/2011 Okunuki ..... A61B 6/032 378/11
7,991,120 B2 * 8/2011 Okunuki ..... A61B 6/00 378/122
8,054,944 B2 * 11/2011 Freudenberger ..... H01J 35/30 378/134
8,155,273 B2 * 4/2012 Eaton ..... H01J 35/16 378/136
8,213,576 B2 * 7/2012 Tomita ..... H01J 35/14 378/137
8,249,216 B2 * 8/2012 Urushiya ..... A61B 6/547 378/92
8,447,013 B2 * 5/2013 Sprenger ..... H01J 35/04 378/122
8,483,361 B2 * 7/2013 Sainath ..... A61B 6/027 378/125
8,488,742 B2 * 7/2013 Tsujii ..... A61B 6/4441 378/138
8,699,657 B2 * 4/2014 Baeumer ..... A61B 6/4035 378/9
8,908,826 B2 * 12/2014 Bernhardt ..... A61B 6/022 378/42
9,153,407 B2 * 10/2015 Jeong ..... H01J 35/065
9,257,254 B2 * 2/2016 Ogura ..... H01J 35/08
9,437,390 B2 * 9/2016 Tomita ..... H01J 35/14
9,653,247 B2 * 5/2017 Tang ..... H01J 35/02
9,653,251 B2 * 5/2017 Tang ..... H01J 35/14
9,659,739 B2 * 5/2017 Bathe ..... H01J 35/305
9,761,404 B2 * 9/2017 Tang ..... H01J 35/06
9,972,473 B2 * 5/2018 Yoshizawa ..... H01J 35/305
10,068,740 B2 * 9/2018 Gupta ..... A61B 6/40
10,076,297 B2 * 9/2018 Bauer ..... A61B 6/4441
10,242,836 B2 * 3/2019 Iida ..... G01T 1/161

* cited by examiner

| Time | Rotation angle (deg) | Cathode parts [Initial coordinate (deg)] | | | | | | | | X-ray focal point (deg) |
|---|---|---|---|---|---|---|---|---|---|---|
| | | 2a_0 [0] | 2a_1 [45] | 2a_2 [90] | 2a_3 [135] | 2a_4 [180] | 2a_5 [225] | 2a_6 [270] | 2a_7 [315] | |
| t0 | 0 | ON | | | | | | | | 0 |
| t1 | 45 | | ON | | | | | | | 0 |
| t2 | 90 | | | ON | | | | | | 0 |
| t3 | 135 | | | | ON | | | | | 0 |
| t4 | 180 | | | | | ON | | | | 0 |
| t5 | 225 | | | | | | ON | | | 0 |
| t6 | 270 | | | | | | | ON | | 0 |
| t7 | 315 | | | | | | | | ON | 0 |

X-RAY TUBE AND A CONTROLLER THEREOF

FIELD OF THE INVENTION

The present invention relates to an X-ray tube and a controller therefor.

DESCRIPTION OF RELATED ART

X-ray tubes used in fluoroscopic photographing for medical or other purposes has a cathode and an anode opposite to the cathode in a vacuum vessel and generates an X-ray from an electron colliding portion on the anode by that cathode electrons collide with the anode. Such X-ray tubes are required to generate X-ray having energy and dose sufficiently high enough to transmit a photogenic subject and to have a sufficiently small X-ray generation portion so as to ensure fineness of a fluoroscopic image necessary for the applications. Thus, energy per unit area produced by cathode electrons at the X-ray generation portion, i.e., electron colliding portion may become large enough to melt the anode which is generally made of metal such as tungsten in a moment, which may break the X-ray tube.

As one of methods for solving the above problem, the following method can be considered. That is, as illustrated in FIG. 6, in an X-ray tube 100, an anode 101 is rotated at high speed to thereby temporally and spatially avoid energy concentration at a focal point 104 with which an electron beam 103 from a cathode 102 collides (refer to, e.g., U.S. Pat. No. 2,242,182). There have been other various inventions relating to such a rotary type anode structure to satisfy securing of a vacuum property and conductivity/heat radiation property and lubricity for high-speed rotation at the same time (refer to, e.g., U.S. Pat. Nos. 5,150,398 and 6,292,538).

SUMMARY

Among these inventions, there is one, like an X-ray tube 200 illustrated in FIG. 7, in which a vacuum vessel 205 itself to which an anode 201 is fixed is rotated to fix the absolute position of a colliding portion (focal point 204) of an electron beam 203 from a cathode 202 on the anode 201 to thereby improve a vacuum holding property/heat radiation property and to eliminate measures for the rotation lubricity. However, in the configuration of FIG. 7, the cathode 202 is fixed to the center of the rotary shaft of the vacuum vessel 205, so that it is necessary to provide a strong magnetic deflection coil 206 outside the rotating vacuum vessel 205 in order to curve the electron beam 203 emitted from the cathode 202 toward the circumference of the anode 201, which may disadvantageously complicate and enlarge the structure. Further, it is difficult to maintain a correct X-ray generation position.

The object of the present invention is to provide an X-ray tube and a controller therefor capable of solving the above problems.

An X-ray tube according to the present invention includes: a vacuum vessel; a cathode and an anode fixedly disposed inside the vacuum vessel; and a rotary mechanism that rotates the vacuum vessel. The cathode is disposed on the circumference with the rotary shaft of the rotary mechanism as its center and includes a plurality of cathode parts that can individually be turned ON/OFF. The anode includes parts opposite to the plurality of cathode parts, respectively.

A controller according to the present invention is a controller that controls an X-ray tube. The X-ray tube includes: a vacuum vessel; a cathode and an anode fixedly disposed inside the vacuum vessel; and a rotary mechanism that rotates the vacuum vessel. The cathode is disposed on the circumference with the rotary shaft of the rotary mechanism as its center and includes a plurality of cathode parts that can individually be turned ON/OFF. The anode includes parts opposite to the plurality of cathode parts, respectively. The controller intermittently or continuously selects one of the plurality of cathode parts that generates an electron beam in a switching manner in sync with the rotation of the rotary mechanism.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

In the present invention, both the anode and cathode are fixed in the X-ray tube, and the X-ray tube itself is rotated. In this configuration, the cathode is continuously arranged, or the plurality of cathode parts are arranged on the circumference so as to correspond an X-ray generating circumference on the anode surface, and the electron beam generation portion of the cathode is switched according to the rotation of the X-ray tube, thereby eliminating the need to provide an electron beam deflection mechanism. It is necessary to switch the electron beam generation portion according to high-speed rotation of the X-ray tube/anode, so that it is preferable to use, not a conventional filament, but a cold cathode as the cathode but not limited thereto.

In other words, the present invention provides a structure of X-ray tube that allows the fixed type anode structure that can be adapted conventionally only for the generation of an X-ray with low energy, low dose, and large-sized generation focal point to be used for the generation of an X-ray with high energy, high dose, and small-sized generation focal point that was realized only by the rotary type anode structure and is characterized by the cathode array disposed on the circumference and sequentially/continuously switching the electron generation portion thereof.

Thus, a mechanically movable part is completely eliminated from the inside of the high-output X-ray tube, and there is no magnetic field mechanism that deflects electrons near the X-ray tube, making it possible to obtain a high-output X-ray from a simple structure.

Hereinafter, first and second embodiments of the present invention will be described successively.

First Embodiment

Figure 1:
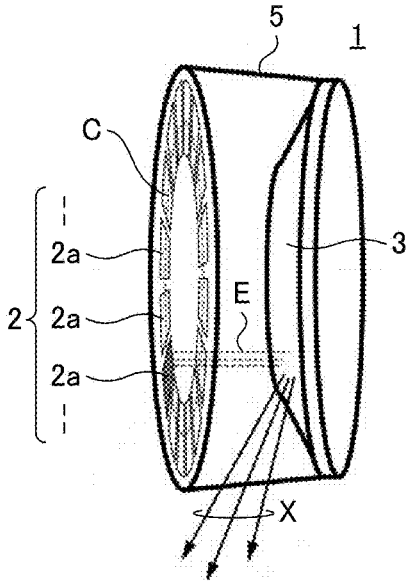
FIG. 1 is a perspective view schematically illustrating a part of an X-ray tube 1 according to a first embodiment of the present invention.
Figure 2:
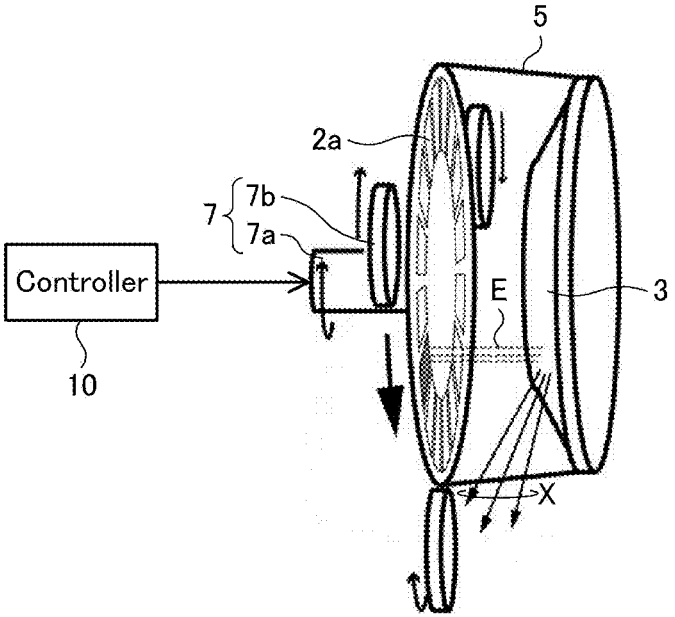
FIG. 2 is a view illustrating the X-ray tube 1 and a controller 10 according to the first embodiment of the present invention.

FIG. 1 is a perspective view schematically illustrating a part of an X-ray tube 1 according to a first embodiment of the present invention, and FIG. 2 is a view illustrating the X-ray tube 1 and a controller 10 according to the first embodiment. As illustrated in FIGS. 1 and 2, the X-ray tube 1 according to the first embodiment of the present invention includes a cathode 2, an anode 3, a vacuum vessel 5, and a rotary mechanism 7.

The cathode 2 is constituted of a plurality of cathode parts 2*a*. The plurality of cathode parts 2*a* are configured as a plurality of parts which are different one another and disposed at equal intervals on a circumference C with the rotary shaft of the rotary mechanism 7 as its center. Further, the plurality of cathode parts 2*a* can individually be turned ON/OFF by the controller 10. A case where a certain cathode part 2*a* is ON means a state where a voltage having a predetermined value is applied to the cathode part 2*a* by the controller 10. The cathode part 2*a* which is turned ON by the voltage application emits an electron beam E toward the anode 3.

The cathode 2 may be configured as a single cathode array. In this case, the plurality of cathode parts 2*a* may be mutually different parts of the single cathode array.

The anode 3 is a single disk-shaped member disposed so as to be opposed to the cathode 2. The anode 3 and circumference C have a common center axis. When the electron beam E is emitted from any of the plurality of cathode parts 2*a*, it collides with the corresponding part of the anode 3, and an X-ray X is generated there.

The vacuum vessel 5 is a substantially cylindrical vessel having a structure capable of keeping the pressure therein lower than the surrounding atmospheric pressure. The cathode 2 and anode 3 are both fixedly disposed inside the vacuum vessel 5. More specifically, the cathode 2 is fixed to the upper base of the vacuum vessel 5 and the anode 3 to the bottom base.

The rotary mechanism 7 is a mechanism rotating the vacuum vessel 5 and includes, e.g., a shaft 7*a* and/or a plurality of friction wheels 7*b* as illustrated in FIG. 2. The plurality of friction wheels 7*b* are disposed in contact with the side surface of the vacuum vessel 5. When the controller 10 rotates the shaft 7*a*, the plurality of friction wheels 7*b* rotate interlocking with the rotation, whereby the vacuum vessel 5 is rotated by friction between the plurality of friction wheels 7*b* and the side surface of the vacuum vessel 5. At the same time, the cathode 2 and anode 3 fixedly disposed in the vacuum vessel 5 rotate. The thus configured rotary mechanism 7 does not require securing of a vacuum property, conductivity, and heat radiation property and thus has a far simpler structure than the above-mentioned rotary anode type rotary mechanism.

In addition to the function of rotating the vacuum vessel 5 by means of the rotary mechanism 7 as described above, the controller 10 also has a function of intermittently or continuously selecting one of the plurality of cathode parts 2*a* that generates the electron beam E in a switching manner in sync with the rotation of the rotary mechanism 7. Hereinafter, this function will be described with two examples. In the following description, the position of each of the cathode 2 and anode 3 is referred to as "absolute position", which means the position as viewed from a coordinate system that is not rotated together with the vacuum vessel 5.

Figure 3A:
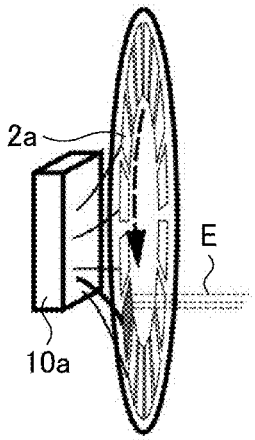
FIG. 3A is a view illustrating a cathode switching circuit 10*a* according to the first embodiment of the present invention.

FIG. 3A is a view illustrating a cathode switching circuit 10*a* included in the controller 10 having an electron beam generation function according to the first example. The cathode switching circuit 10*a* is configured to be rotated together with the vacuum vessel 5 and connected to the plurality of cathode parts 2*a* through wirings. Although not illustrated, the cathode switching circuit 10*a* includes therein a switching circuit for setting one of the wirings connected to the respective cathode parts 2*a* in a connection state and the remaining wirings in a disconnection state.

The controller 10 according to the first example controls the cathode switching circuit 10*a* when rotating the vacuum vessel 5 so that the electron beam E is emitted from one of the plurality of cathode parts 2*a* that is located at a predetermined absolute position. Specifically, the controller 10 controls the cathode switching circuit 10*a* so as to set the wiring connected to the cathode part 2*a* located at the predetermined absolute position in a connection state and set the wirings connected to the remaining cathode parts 2*a* in a disconnection state and then applies a voltage to the cathode 2 via the cathode switching circuit 10*a*. As a result, the electron beam E is emitted from only the cathode part 2*a* located at the predetermined absolute position. This allows the X-ray tube 1 to always generate the X-ray X from a fixed absolute position.

Figure 3B:
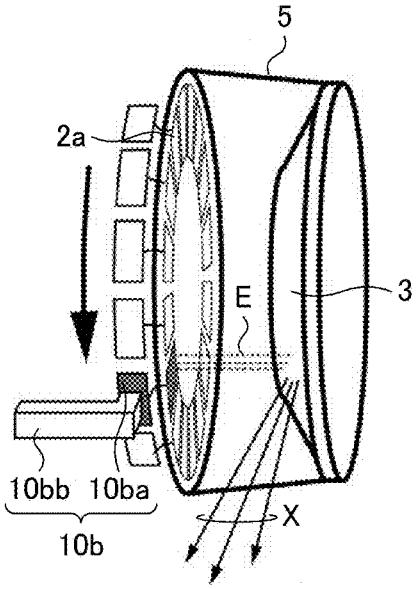
FIG. 3B is a view illustrating a contact mechanism 10*b* according to the first embodiment of the present invention.

FIG. 3B is a view illustrating a contact mechanism 10*b* included in the controller 10 having an electron beam generation function according to the second example. As illustrated in FIG. 3B, the contact mechanism 10*b* includes a plurality of terminals 10*ba* fixed to the plurality of cathode parts 2*a* respectively and a fixed brush 10*bb* which is not rotated together with the vacuum vessel 5. The terminals 10*ba* are electrically connected to their corresponding cathode parts 2*a*. The fixed brush 10*bb* is electrically connected to one of the plurality of terminals 10*ba* that is located at the absolute position.

In this second example, the fixed brush 10*bb* is always electrically connected to one of the plurality of terminals 10*ba* that is located at the predetermined absolute position even when the vacuum vessel 5 is rotated under the control of the controller 10. Thus, the controller 10 according to this second example may simply apply a voltage to the fixed brush 10*bb*. As a result, the electron beam E is emitted from only the cathode part 2*a* located at the predetermined absolute position. This allows the X-ray tube 1 to always generate the X-ray X from a fixed absolute position.

Figures 4, 5:
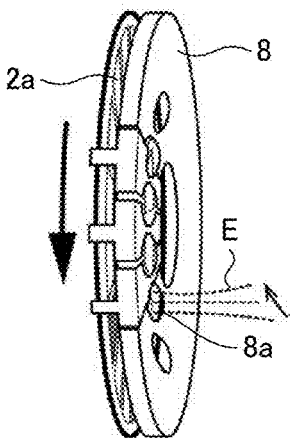
FIG. 4 is a view illustrating a relationship according to the first embodiment of the present invention between the rotation angle of the vacuum vessel 5 and the cathode part 2*a* that emits the electron beam E.
FIG. 5 is a perspective view schematically illustrating a part of the X-ray tube 1 according to a second embodiment.
Figure 6:
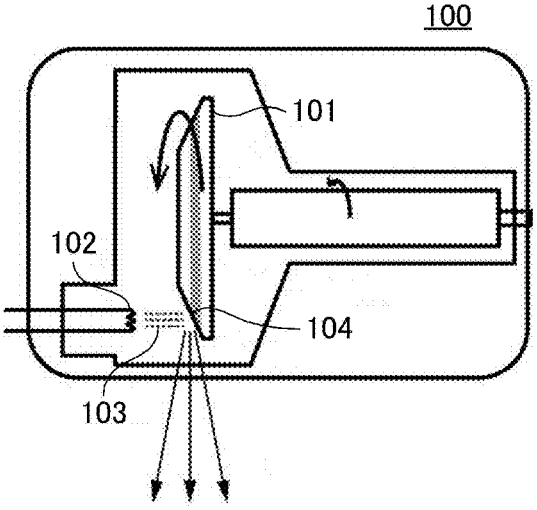
FIG. 6 is a diagram indicating an X-ray tube 100 according to a related art of the present invention.
Figure 7:
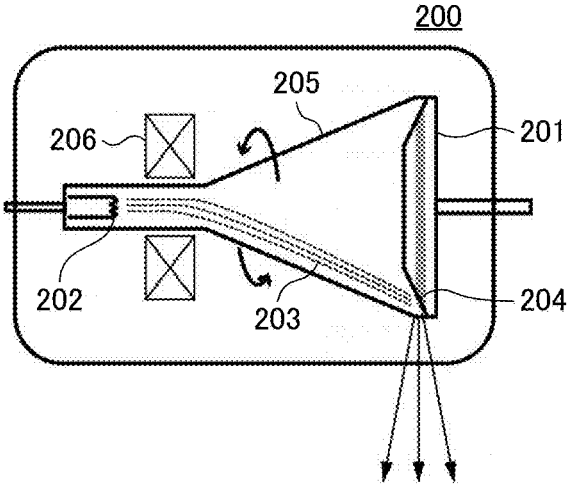
FIG. 7 is a diagram indicating an X-ray tube 200 according to a related art of the present invention.

FIG. 4 is a view illustrating the relationship between the rotation angle of the vacuum vessel 5 and the cathode part 2*a* that emits the electron beam E. Hereinafter, with reference to FIG. 4, the control performed by the controller 10 will be described more in detail.

FIG. 4 illustrates an example in which the cathode 2 is constituted of eight cathode parts 2*a*_0 to 2*a*_7. These cathode parts 2*a*_0 to 2*a*_7 are arranged at a pitch of 45° along the circumference C illustrated in FIG. 1. The angle illustrated as the initial coordinate in FIG. 4 indicates the absolute position and, as illustrated in FIG. 4, the absolute positions of the respective cathode parts 2*a*_*k* (k=0 to 7) in the initial state (rotation angle=0°) are each 45 k°. Thus, the absolute positions of the cathode parts 2*a_k* when the vacuum vessel 5 is rotated by 45 k° from the initial position can be set to 0° irrespective of the value of k.

The controller 10 makes the cathode parts 2*a_k* generate the electron beam E in the way described above at times tk at which the vacuum vessel 5 is rotated by 45 k° from the initial state. Since the absolute positions of the cathode parts 2*a_k* at the times tk are set to 0° irrespective of the value of k as described above, the electron beam E is always emitted from the same absolute position (=0°). Accordingly, the position (X-ray focal point) at which the electron beam E collides with the anode 3 is always 0°. Thus, according to the control performed by the controller 10 illustrated in FIG. 4, the X-ray X can always be generated from a fixed position even in the configuration where the anode 3 is not rotated relative to the vacuum vessel 5.

As described above, according to the X-ray tube 1 and the controller 10 of the present embodiment, the X-ray X can always be generated from a fixed position even in the configuration where the anode 3 is not rotated relative to the vacuum vessel 5. This prevents electronic energy from concentrating on a fixed position of the anode 3, so that effects equivalent to those in the rotary type anode structure can be obtained even in the configuration where the anode 3 is not rotated relative to the vacuum vessel 5.

Second Embodiment

FIG. 5 is a perspective view schematically illustrating a part of the X-ray tube 1 according to a second embodiment. Although not illustrated in FIG. 5, like the X-ray tube 1 of the first embodiment, the X-ray tube 1 according to the second embodiment includes the vacuum vessel 5, anode 3, and rotary mechanism 7. The X-ray tube 1 according to the present embodiment differs from the X-ray tube 1 according to the first embodiment in that an electrostatic deflection mechanism 8 is additionally provided. Hereinafter, description will be made focusing differences from the first embodiment with the same reference numerals given to the same elements as in the first embodiment.

The electrostatic deflection mechanism 8 is a doughnut-shaped member disposed between the cathode 2 and the anode 3 and is fixed in the vacuum vessel 5 through the cathode 2. The electrostatic deflection mechanism 8 has a plurality of openings 8*a* one-to-one corresponding to the plurality of cathode parts 2*a* apart from a center opening. The electron beam E emitted from each cathode part 2*a* passes through the corresponding opening 8*a* and collides with the anode 3. With the configuration where the electron beam E emitted from each cathode part 2*a* passes through the corresponding opening 8*a*, the electrostatic deflection mechanism 8 plays a role of controlling the focal diameter of the electron beam E generated by the cathode part 2*a* to a fixed value as well as a role of controlling the path of the electron beam E so that the electron beam E collides with a specific position (e.g., the position corresponding to the absolute angle 0° in the example of FIG. 4) on the anode 3. That is, the electrostatic deflection mechanism 8 plays a role of canceling the rotations of the vacuum vessel 5 and anode 3 to efficiently disperse concentration of electronic energy on the anode 3 by sequentially repeating deflection of the electron beam E in a short range.

As described above, according to the X-ray tube 1 of the present embodiment, the electrostatic deflection mechanism 8 that controls the path of the electron beam E so that the electron beam E collides with a specific position on the anode 3 is provided between the cathode 2 and the anode 3, thereby allowing the electron beam E to always collide with a specific a position on the anode 3.

While the preferred embodiments of the present invention have been described, the present invention is not limited to the above embodiments but may be variously modified within the scope thereof.

What is claimed is:

1. An X-ray tube comprising:

a vacuum vessel;

a cathode and an anode fixedly disposed inside the vacuum vessel;

a rotary mechanism comprising a rotary shaft that is configured to rotate the vacuum vessel, wherein the cathode being disposed on a circumference with the rotary shaft as its center and including a plurality of cathode parts that can individually be turned ON/OFF, and the anode including parts opposite to the plurality of cathode parts respectively;

a cathode switching circuit coupled to the cathode; and a controller coupled to the cathode switching circuit and configured to intermittently or continuously select one of the plurality of cathode parts when in an absolute position as viewed from a coordinate system that is not rotated together with the vacuum vessel to generate an electron beam in a switching manner in sync with a rotation of the rotary shaft so that the anode generates X-rays from a fixed absolute position.

2. The X-ray tube according to claim 1, wherein the anode is configured as a single disk-shaped member opposite to the cathode, and X-rays are generated from different parts of the anode as they are brought into the fixed absolute position.

3. The X-ray tube according to claim 1, wherein the plurality of cathode parts are configured as mutually different members.

4. The X-ray tube according to claim 1, wherein the cathode is configured as a single cathode array, and the plurality of cathode parts are mutually different parts of the single cathode array.

5. The X-ray tube according to claim 1, further comprising an electrostatic deflection mechanism disposed between the cathode and the anode wherein the electrostatic deflection mechanism controls a path of an electron beam so that the electron beam generated by one of a plurality of cathode parts that is in a turned ON state collides with a specific position on the anode.

6. The X-ray tube of claim 1, wherein the cathode switching circuit is configured to be rotated together with the vacuum vessel, and is connected to the plurality of cathode parts through wirings and selectively activates different cathode parts of the plurality of cathode parts as the different cathode parts of the plurality of cathode parts are rotated into the fixed absolute position.

7. The X-ray tube of claim 1, wherein the cathode switching circuit comprises a plurality of terminals fixed respectively to the plurality of cathode parts and protruding from the vacuum vessel, and a fixed brush in an absolute position configured to selectively couple to a terminal of each cathode part of the plurality of cathode parts as each cathode part of the plurality of cathode parts is rotated into the fixed absolute position.

8. A system for controlling an X-ray tube, wherein the X-ray tube comprises:

a vacuum vessel, a cathode and an anode fixedly disposed inside the vacuum vessel, a rotary mechanism comprising a rotary shaft that is configured to rotate the vacuum vessel, wherein the cathode is disposed on a circumference with the rotary shaft at its center and comprises a plurality of cathode parts that are configured to be individually turned ON/OFF, and the anode includes parts opposite to the plurality of cathode parts, respectively, and a cathode switching circuit coupled to the cathode, wherein the system comprises:

a controller coupled to the cathode switching circuit and configured to intermittently or continuously select one of the plurality of cathode parts when in an absolute position as viewed from a coordinate system that is not rotated together with the vacuum vessel to generate an electron beam in a switching manner in sync with a rotation of the rotary shaft so that X-rays are generated from a part of the parts of the anode opposite to the one of the plurality of cathode parts when the part of the parts of the anode is brought into a fixed absolute position.

* * * * *